US009138754B2

(12) United States Patent
Steingass et al.

(10) Patent No.: US 9,138,754 B2
(45) Date of Patent: Sep. 22, 2015

(54) ADJUSTABLE FIREFIGHTING NOZZLE

(71) Applicant: TASK FORCE TIPS, INCORPORATED, Valparaiso, IN (US)

(72) Inventors: Robert W. Steingass, Valparaiso, IN (US); Stewart McMillan, Valparaiso, IN (US); Gene Spencer, Valparaiso, IN (US); David J. Kolacz, Plymouth, IN (US)

(73) Assignee: TASK FORCE TIPS, INCORPORATED, Valparaiso, IN (US)

( * ) Notice: Subject to any disclaimer, the term of this patent is extended or adjusted under 35 U.S.C. 154(b) by 100 days.

(21) Appl. No.: 13/790,205

(22) Filed: Mar. 8, 2013

(65) Prior Publication Data

US 2013/0256427 A1 Oct. 3, 2013

Related U.S. Application Data

(60) Provisional application No. 61/616,092, filed on Mar. 27, 2012.

(51) Int. Cl.

| | |
|---|---|
| ***B05B 1/12*** | (2006.01) |
| ***A62C 31/03*** | (2006.01) |
| *B05B 15/06* | (2006.01) |

(52) U.S. Cl.

CPC . *B05B 1/12* (2013.01); *A62C 31/03* (2013.01); *B05B 15/065* (2013.01)

(58) Field of Classification Search

CPC ..... B05B 1/1645; B05B 15/069; B05B 1/12; B05B 15/065; A62C 31/00–31/28

USPC ..... 239/548, 550, 563, 587.1, 587.2, 587.5, 239/587.6, 436, 447, 393

See application file for complete search history.

(56) References Cited

U.S. PATENT DOCUMENTS

| | | | | |
|---|---|---|---|---|
| 28,865 | A | 6/1860 | Howells | |
| 33,200 | A | 9/1861 | Jeffers | |
| 141,620 | A * | 8/1873 | Barton | 239/393 |
| 155,020 | A * | 9/1874 | Gassett | 239/393 |
| 157,527 | A | 12/1874 | Leggett | |
| 174,781 | A | 3/1876 | Clemens | |
| 476,966 | A | 6/1892 | Spencer | |
| 597,182 | A | 1/1898 | Hart | |
| 658,586 | A | 9/1900 | Reiling | |
| 692,375 | A | 2/1902 | Snider et al. | |
| 1,964,807 | A | 7/1934 | Baum | |
| D352,344 | S * | 11/1994 | Mizuguchi | D23/213 |
| 6,796,464 | B1 * | 9/2004 | Tung | 222/402.17 |
| D536,970 | S * | 2/2007 | Shannan et al. | D9/448 |
| 7,258,285 | B1 | 8/2007 | Combs et al. | |
| RE40,441 | E | 7/2008 | Kolacz et al. | |
| 7,600,701 | B2 * | 10/2009 | Jasper et al. | 239/337 |
| 7,802,630 | B2 | 9/2010 | Combs et al. | |
| 7,971,800 | B2 | 7/2011 | Combs et al. | |
| 8,006,923 | B2 | 8/2011 | Stoops | |

* cited by examiner

*Primary Examiner* — Arthur O Hall
*Assistant Examiner* — Juan C Barrera
(74) *Attorney, Agent, or Firm* — Marshall, Gerstein & Borun LLP

(57) ABSTRACT

A new firefighting nozzle has a base nozzle with one size or type of orifice and one or more auxiliary nozzles with a different size or type of orifice that a firefighter can easily see. A firefighter can swing the auxiliary nozzle into series with the base nozzle to change the flow. A springy element biases a locking element on the auxiliary nozzle from a retracted position toward an extended position in which it locks the auxiliary nozzle in place.

18 Claims, 35 Drawing Sheets

ADJUSTABLE FIREFIGHTING NOZZLE

BACKGROUND

Smooth-bore nozzles are in common use on the fire ground for extinguishing and controlling fires using water, foam, compressed air foam, or dry chemicals. It is common to have a series of two or more nozzles assembled into a stack with the smallest nozzle on the end of the stack, and progressively larger nozzles underneath. Normally the nozzles are connected to each other with fire hose threads or a quick connecting coupling such as a Storz coupling.

Between fires, the nozzles remain connected in series to prevent the disconnected elements from being lost or misplaced at the scene of a fire. Consequently, the smallest nozzle by default is the one ready for deployment at the start of a fire. Unfortunately, the smallest nozzle provides the least protective fire knockdown power and compromises the effectiveness of the firefighter. Moreover, when the flow of the smaller nozzle proves insufficient, then precious time must be spent to shut down the flow, remove the smaller nozzle, and find a pocket or other convenient location to keep the smaller nozzle in case it is needed again.

Firefighting nozzles with multiple-sized orifices arranged with their central axes parallel to the axis of the hose line have been devised. Some prior art nozzles had a series of orifices arranged to be brought into alignment in the manner of a cylinder on a six-shooter revolver, or worked by diverting the discharge in the manner of a double barrel shotgun (under/over, or side-by side). Other multiple-orifice nozzles have been described as having a rotating head and several nozzles. In these prior art devices, the orifice type and size must be engineered into the product, leaving the user without any opportunity to connect a discharge tip of his or her own choosing.

Still other nozzle designs have diverted some or all of the flow through a secondary channel to give concentric discharge of an outer spray pattern and an inner spray pattern. When both nozzles are operated in series, these devices do not have a simple smooth-bore shape with an unobstructed flow. As such, they do not appeal to firefighters who believe that the simple, unobstructed, tapered cylindrical waterway of a smooth-bore nozzle is the most effective. While peripheral jet nozzles have sought to overcome this drawback by means of an orifice whose size is adjustable, the abrupt changes in direction or flow area of this nozzle type is well known to degrade the quality of compressed air foam. Thus, their use with compressed air foam systems (CAFS) is generally frowned upon.

A variant on smooth-bore nozzles for use with CAFS was patented by Elkhart Brass as a "adjustable smooth bore nozzle." That arrangement has a membrane whose at-rest diameter is smaller than the maximum diameter desired as indicated by the diameter adjustment setting on the nozzle. When operating at the maximum condition, the membrane must be expanded to a larger size, and this expansion exerts pressure on the foam and thus constricts the foam and degrades the properties of the foam.

Both the peripheral-jet and the adjustable, smooth-bore nozzle types have internal mechanisms that use an external control system to change the internal size of movable members. The position of the external control device must be interpreted by markings to determine what setting the nozzle is in. Some firemen prefer the simplicity of observing a simple round discharge opening for discharging fluids at a fire. Those arrangements are easy to understand, and it is visually obvious which size nozzle has been brought to bear on the fire without having to interpret markings, which can be difficult in situations where visibility may be obscured by smoke or darkness.

SUMMARY OF THE DISCLOSURE

The applicants have developed a firefighting nozzle that a firefighter can rapidly switch between two modes of operation: a larger-diameter, smooth-bore mode, and a second auxiliary mode that may provide less flow or flow of a different spray type.

The new firefighting nozzle is equipped with two discharge nozzles that have different sized orifices; a base nozzle and an auxiliary nozzle. The auxiliary nozzle can be swung between an operating position and a stowed position. In the operating position, the auxiliary nozzle is in series with as well as coaxial with the base nozzle. In the stowed position, the auxiliary discharge nozzle is completely out of the path of the flow issued from a base orifice on the base nozzle.

Less flow can be provided by using a smaller-diameter, smooth-bore nozzle as the auxiliary nozzle. The ability to swing such a nozzle into the operating position provides a functional adjustability that is comparable to the functionality provided in U.S. Pat. No. 157,527, in which the terminal diameter of the nozzle could be varied. Using a smooth-bore nozzle as the auxiliary nozzle provides a simple unobstructed internal waterway in the form of a tapered cylinder. Operating the base nozzle with such an auxiliary nozzle in series provides for a long unobstructed tapered internal flow path. No movable internal mechanism is required to vary the diameter of the discharge orifice.

A different spray type can be provided by using an auxiliary nozzle that modifies the shape of the discharge pattern after the flow has issued from the smooth-bore base orifice.

The auxiliary discharge nozzle on the new firefighting nozzle can include a standard fire-hose connection onto which a third nozzle of the firefighter's liking may be attached or exchanged at will. In addition or alternatively, a plurality of auxiliary discharge nozzles can be arranged in a series of swinging connections, such that the auxiliary nozzles can be successively added in series to a base nozzle.

In use, the discharge orifice size can be determined tactually by observing the orientation of the auxiliary nozzle, without the need to interpret positional markings, or trust that an internal mechanism hidden from view has completed a desired orifice size change. Thus, the proper-sized nozzle may be brought to bear on the fire by feel alone, without any need to rely on interpretation of markings. This is particularly advantageous in situations where visibility is obscured by thick smoke and darkness.

The new firefighting nozzle may be equipped with a pistol grip and, when the auxiliary nozzle is swung out of the way of the base nozzle into a stowed position, the auxiliary nozzle screens the pistol grips and thus can serve as a hand guard to protect the hand of the firefighter grasping that grip.

The new product may also be provided with a position-locking mechanism that secures the auxiliary nozzle in position. Detents can be loaded by a springy element to retain the locked position of the auxiliary nozzle. In one arrangement of the nozzle, the detents can be overcome by applying a force to the auxiliary nozzle in a direction that moves it between positions. In an alternative arrangement, the locking mechanism must first be moved from a locked position to an unlocked position.

In some settings, the position-locking mechanism in the new firefighting nozzle can be arranged to use water pressure to lock the auxiliary nozzle in position.

After use, the new arrangement permits the firefighting nozzle to be stored in a default position where the larger discharge nozzle is ready for immediate use without changing or adjusting nozzle types or settings, while the smaller discharge nozzle is swung out of the way into in a stowed position where it doesn't contact the flow of liquid from the larger nozzle. The nozzle can be rapidly converted between two modes of operation without attaching or detaching separate components, eliminating the risk of misplacing a component.

DETAILED DESCRIPTION

Figure 1A:
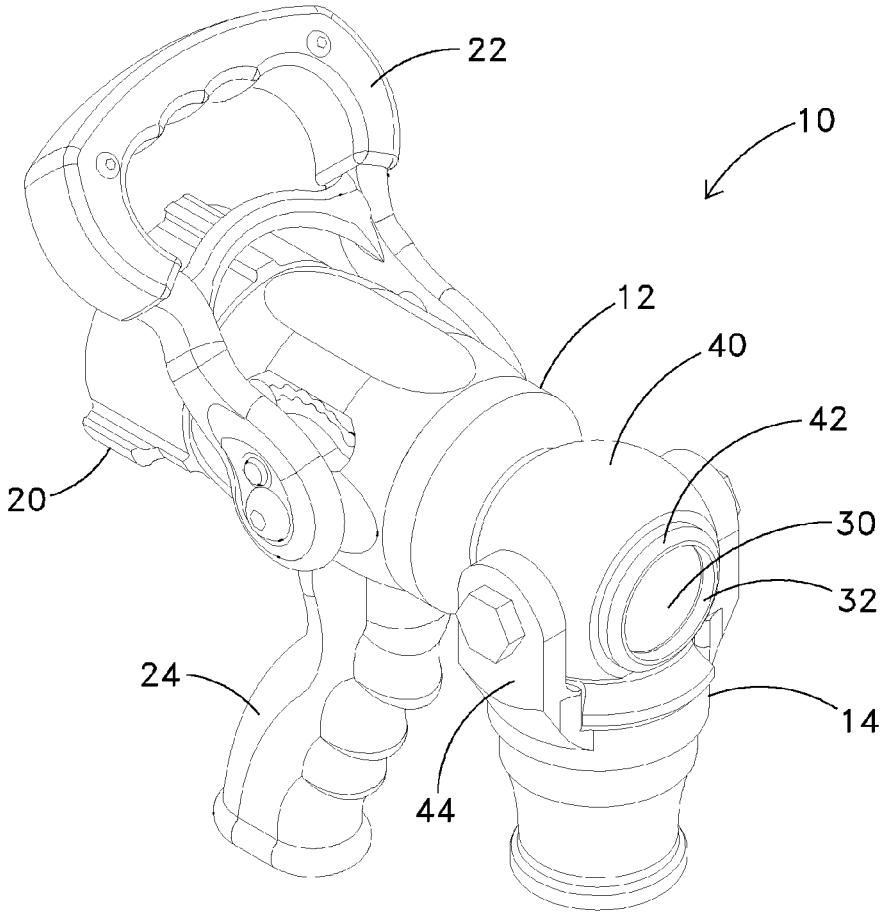
FIGS. 1A-G are isometric and back, front, side, top, and bottom views of one embodiment of a firefighting nozzle that uses the new invention.
Figure 1B:
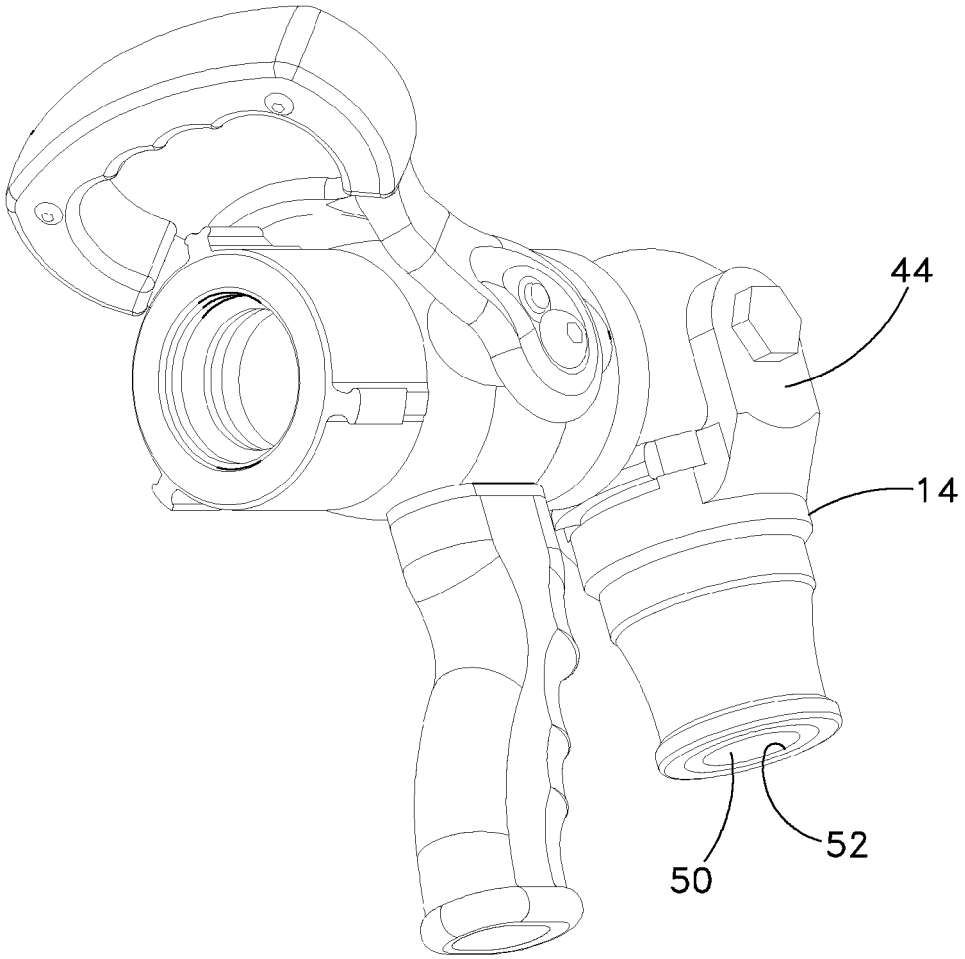
Figure 1C:
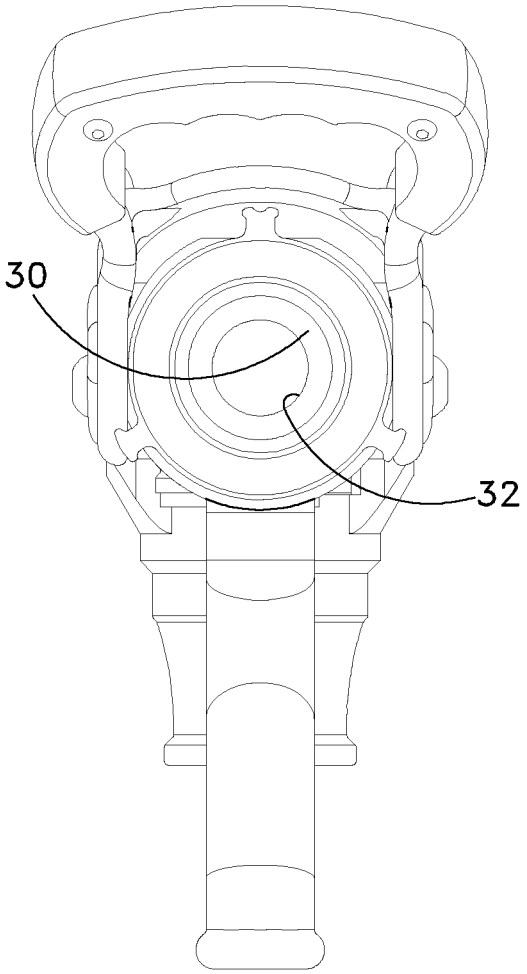

The structure and the operation of the new firefighting nozzle 10 will each be described in turn.

Structure

The firefighting nozzle that is illustrated in FIGS. 1 and 2 has a base nozzle 12 and an auxiliary nozzle 14.

The base nozzle 12 is, in many respects, similar to firefighting nozzles in common use. It includes a hose coupling 20 that can be attached to a fire hose or monitor (with for example, rocker lug type fire hose thread or a Storz type coupling) and a lever 22 that can be used to control the flow of liquid or foam through the nozzle, such as with a ball valve. The illustrated base nozzle, which is designed for use as a hand-held nozzle, has an optional pistol grip 24 that a firefighter can use to hold the nozzle. A similar nozzle can be used on a firefighting monitor.

As best seen in FIGS. 1A-D, the illustrated base nozzle 12 has a smooth, tapered bore 30 that leads to a relatively large primary orifice 32.

Unlike previously known nozzles, however, the new base nozzle 12 also has a spherical ball section 40 onto which the auxiliary nozzle 14 is connected. Although other arrangements are possible, the connecting portion on the illustrated firefighting nozzle 10 has a connecting portion 42. Each nozzle has an unobstructed internal waterways that is visible to a user under firefighting conditions.

The auxiliary nozzle 14 has a back end 44 that fits onto the connecting portion 42 of the base nozzle 12. The illustrated auxiliary nozzle is has a tapered shape and is pivotably connected to the base nozzle using a ball-in-socket configuration. This arrangement keeps the width of the product smaller than is possible using a "six shooter" configuration to swing or rotate between nozzle sizes. Although a spherical shape is depicted on the illustrated base nozzle, other arrangements could also be used. For example, the auxiliary nozzle could be connected using a cylindrical pivot that has an axis of rotation that is coincident with the discharge axis of the base nozzle. As another example, the pivot could be offset to one side and operate in the fashion of a door hinge, with a corresponding latch used to latch the auxiliary nozzle in position.

Figure 6:
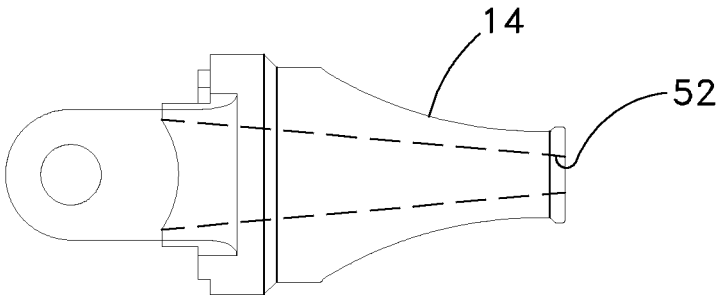
FIGS. 6-8 are partial cross-sectional side views of alternative smooth bore auxiliary nozzles that could be used with the nozzle of FIGS. 1 and 2.
Figure 7:
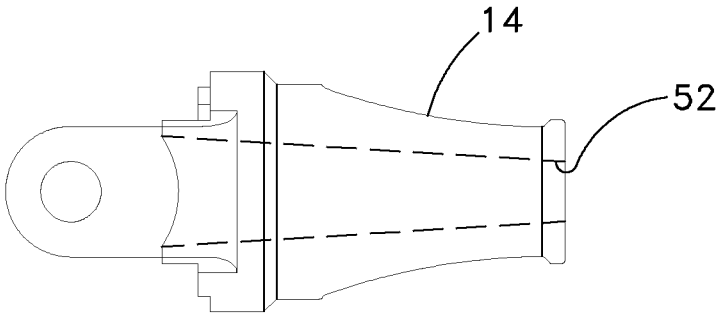
Figure 8:
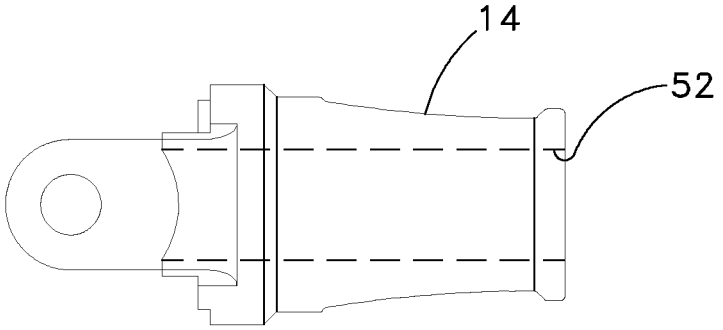

The auxiliary nozzle 14 seen in FIGS. 1 and 2 also has a smooth tapered bore 50 (FIGS. 1G, 2A) that begins near the back end 44 of the auxiliary nozzle. Preferably, the bore at the back end is similar in size to the relatively large primary orifice 32 on the base nozzle 12. The tapered bore 50 on the auxiliary nozzle tapers down from the back end to a relatively small auxiliary orifice 52 on the downstream end. As seen in FIGS. 6-8, the nature and amount of tapering of the bore in the auxiliary nozzle can vary. The taper serves to create a coherent smooth bore jet with minimal turbulence, which is needed to project the fluids farther.

A specific taper in the bore can be permanent or adjustable. A permanent tapered bore can be made by machining the desired profile on the interior of the waterway. An adjustable bore can be provided by using interchangeable inserts. One taper can be provided by simply pushing an inserts into a retained position in the auxiliary nozzle (or even in the base nozzle). Another taper can be provided by removing that insert and/or replacing it with another in a series of interchangeable inserts. When either machining or using inserts, the smooth bore has fixed (i.e. rigid) walls that do not exert pressure on exiting foam in the same way that the Elkhart Brass adjustable smooth-bore nozzle does.

Figure 9:
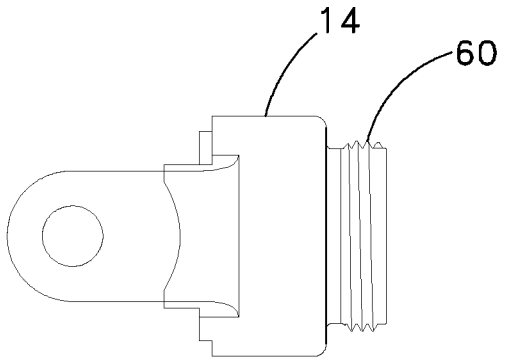
FIGS. 9 and 10 are side views of alternative auxiliary nozzles that could be used with the nozzle of FIGS. 1 and 2 and have alternative connectors.
Figure 10:
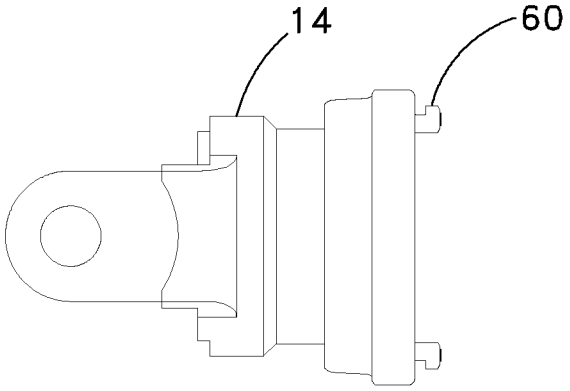

As seen in FIGS. 9 and 10, the auxiliary nozzle 14 can also be provided with fire hose connection 60 that can be used to attach a conventional firefighting tip. FIG. 9 shows a standard threaded connection. FIG. 10 shows a quick-connect connection, such as a Storz, DSP, Gost, or cam lock connection. These arrangements enable a firefighter to add a firefighting tip of their own choosing to the auxiliary nozzle without the use of tools, enabling the firefighter to readily swing that tip into action, and to swing it out of action without having to unthread it of find a place to store the tip.

Figure 11:
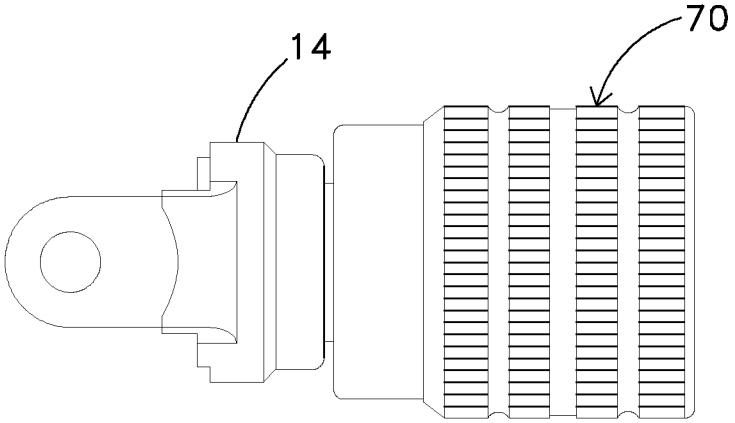
FIGS. 11 and 12 are side views of alternative auxiliary nozzles that could be used with the nozzle of FIGS. 1 and 2 and have peripheral jet tips.
Figure 12:
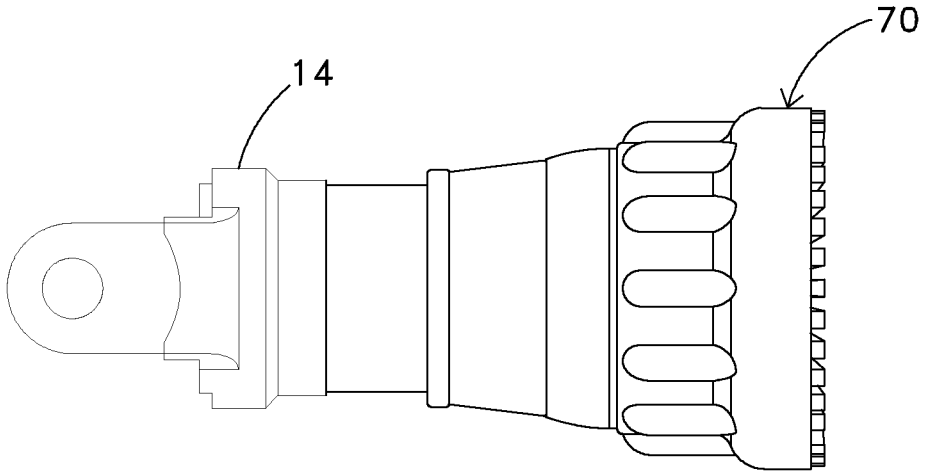

Instead of having a smooth bore with a smaller diameter than that of the base nozzle 12, the auxiliary nozzle 14 can be arranged to discharge a wider flat, cone, or diffused pattern, or otherwise modify the shape of the discharge pattern after the flow has issued from the primary orifice 32. For example, a tip-only peripheral jet nozzle 70 of various types could also be used, as seen in FIGS. 11 and 12. Thus, possible combinations of base nozzle and auxiliary nozzle in a handheld nozzle include, for example:

- FDNY (Fire Department of New York) smooth bore: Base tip is 15/16", while auxiliary nozzle is ½"
- CAFS (Compressed Air Foam System) nozzle DRY/WET: Base tip is 1¼" (dry foam), while auxiliary nozzle is 15/16 (wet foam)
- CAFS nozzle DRY/WET: Base tip is 1⅜" (dry foam), while auxiliary nozzle is 15/16 (wet foam)

CAFS nozzle DRY/WET: Base tip is 1⅜" (dry foam), while auxiliary nozzle is an adjustable smoothbore of the type depicted in an existing patent such as U.S. Pat. No. 7,971,800

CAFS nozzle: Base tip is 1⅜" (dry foam), while auxiliary nozzle includes a fire hose connection onto which a nozzle of the users choice may be installed VIT (valve integral tip) nozzle: Base tip is 1¼", while auxiliary nozzle is includes a peripheral jet fire hose nozzle with a pivoting inlet for permanent connection to the base tip Multiple auxiliary nozzle combinations with various smooth bores, fire hose connections, or integrated peripheral jet nozzles With respect to use of the nozzle on firefighting monitors, the possible combinations include, for example:

Nozzle for portable monitor with flow up to 500 GPM: Base tip is 1.5" internal diameter, while auxiliary nozzle is 1"

Nozzle for portable or fixed monitor with flow up to 1250 GPM: Base tip is 2.0", while auxiliary nozzle is 1⅜"

Nozzle for fixed monitor with flow up to 2000 GPM: Base tip is 2.5", while auxiliary nozzle is 2"

In any case, the auxiliary nozzle 14 is pivotably connected onto the base nozzle 12 in a way that enables the auxiliary nozzle to be moved between a stowed position (FIGS. 1 and 3) and an operating position (FIGS. 2 and 4). The extended length of the auxiliary nozzle, extending downwardly beneath the bottom of the hose coupling 20 when in the stowed position, makes it easy for the firefighter to find it and to grasp it with his full hand to move it between positions.

Operation

In operation, the firefighting nozzle 10 may be used in either of two different modes: a large-flow mode in which the flow is discharged from the primary orifice 32 and a second mode in which the flow is discharged through the auxiliary orifice 52.

In the large-flow mode illustrated in FIGS. 1 and 3, the larger base nozzle 12 is open for normal use and the flow is discharged through it, while the auxiliary nozzle 14 rests in an adjacent stowed position. In this mode, the auxiliary nozzle is out of the flow path but remains attached to the base nozzle. In the arrangement seen in FIGS. 1 and 3, where the stowed position of the auxiliary nozzle is oriented to coincide with the pistol grip 24, the stowed auxiliary nozzle forms a hand-guard, protecting the firefighter's hand on the pistol grip.

A switch to the secondary mode is achieved by swinging the auxiliary nozzle 14 over the primary orifice 32 on the base nozzle 12, thus causing the flow from the primary orifice to be directed into the auxiliary nozzle before being discharged. Placing this nozzle into the stream of fluid results in the liquid or foam ultimately being discharged though a different, here smaller, terminal diameter (auxiliary orifice 52), providing the firefighter with desired adjustability.

By simply visually observing the rotational position of the auxiliary nozzle 14 (a relatively large element, i.e., more than an inch wide in every dimension), a firefighter can easily determine which mode is being used.

The auxiliary nozzle 14 is intended to be swung between positions while the flow of the fluid is halted, in the same way that a conventional stacked tip nozzle must be threaded into place with the fluid supply shut off. However, in adverse conditions, the position of the auxiliary nozzle of the present invention might be forced between positions while fluid is still flowing.

The positions of the auxiliary nozzle 14 may be retained by a variety of methods including:

Friction alone, as in the case of an O-ring, or spring-loaded seat made from two-side-by-side o-rings made of a polymer such as UHMW (Ultra High Molecular Weight polyethylene), which can also serve as a seal between the base nozzle 12 and the auxiliary nozzle 14

Figure 1D:
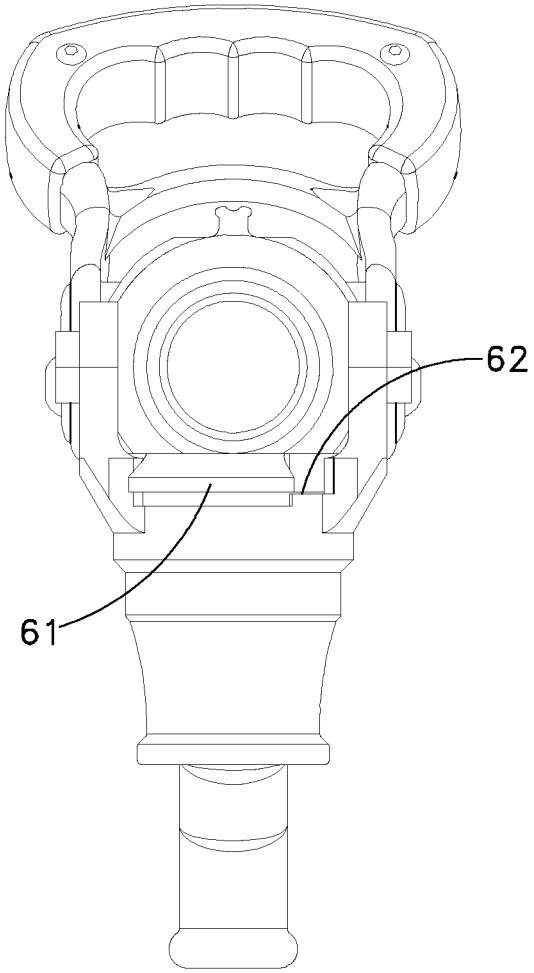
Figure 1E:
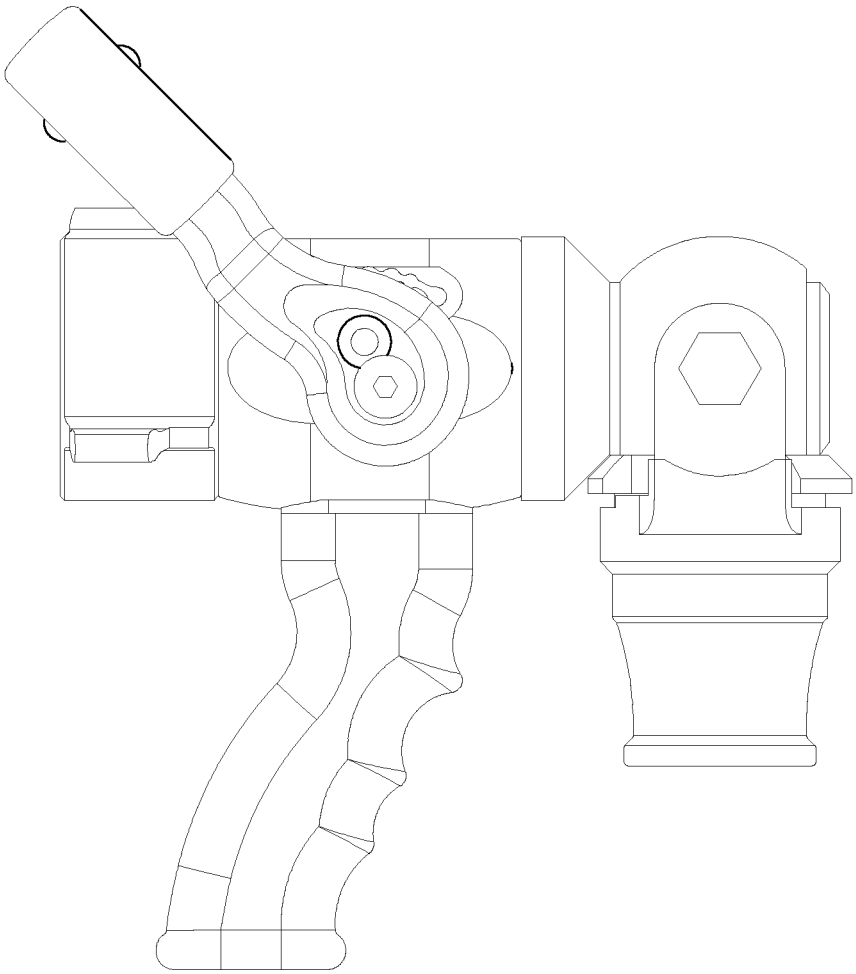
Figure 1F:
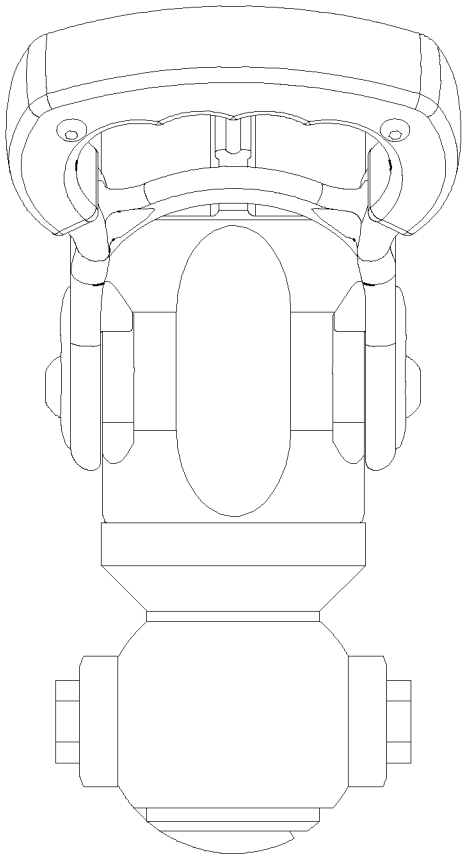
Figure 1G:
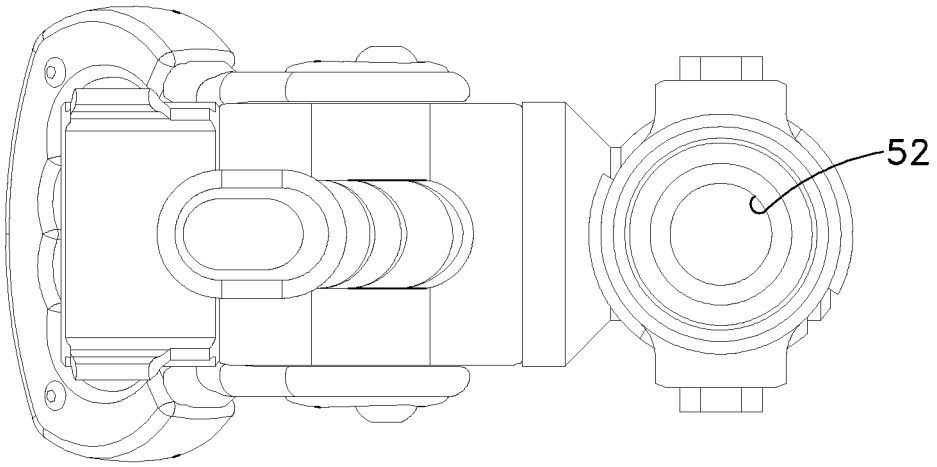
Figure 2A:
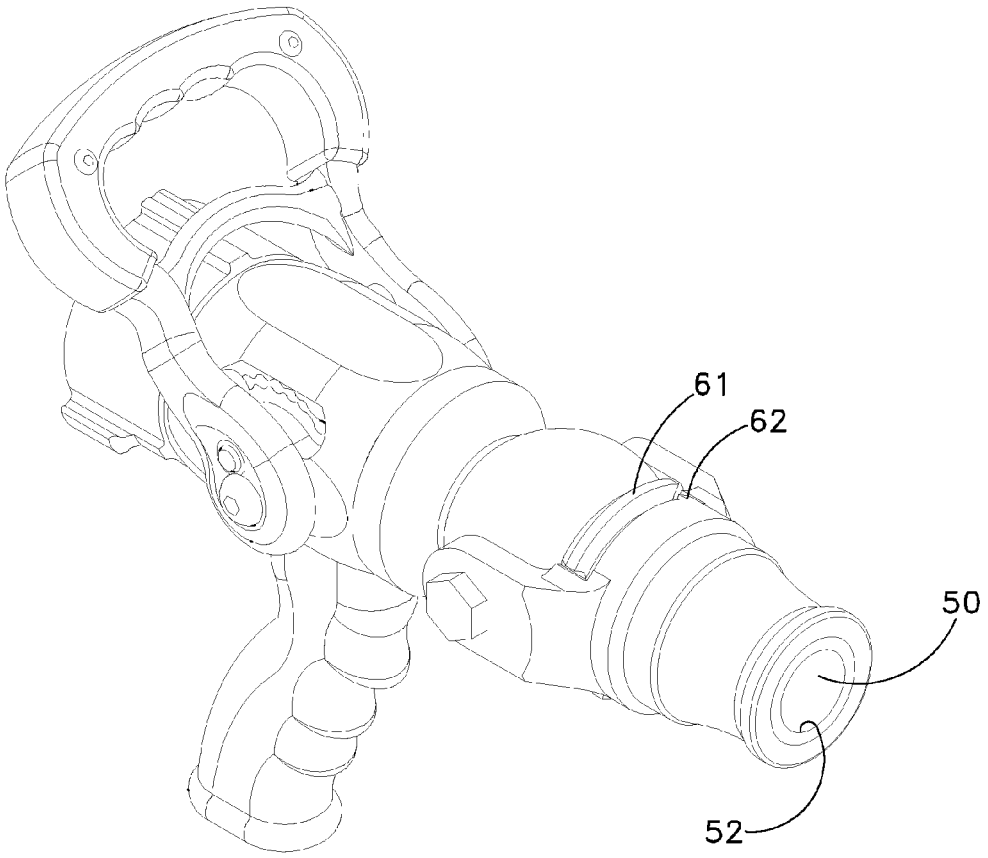
FIGS. 2A-G are similar views of the same nozzle in a different position.
Figure 2B:
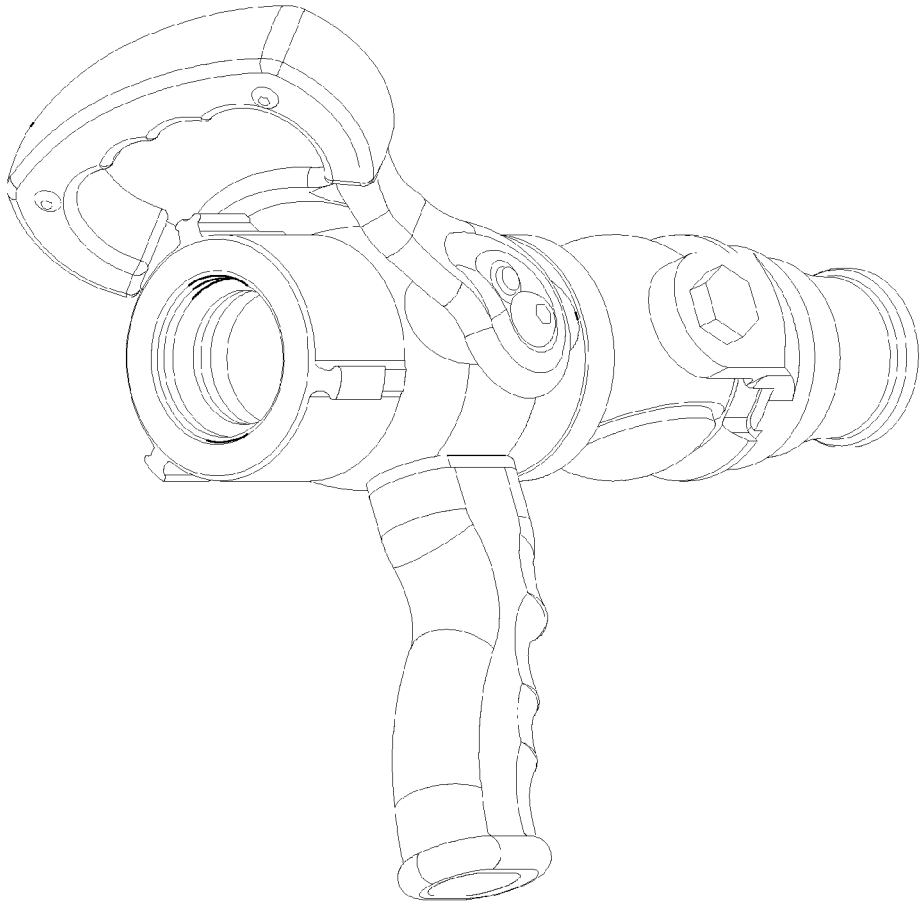
Figure 2C:
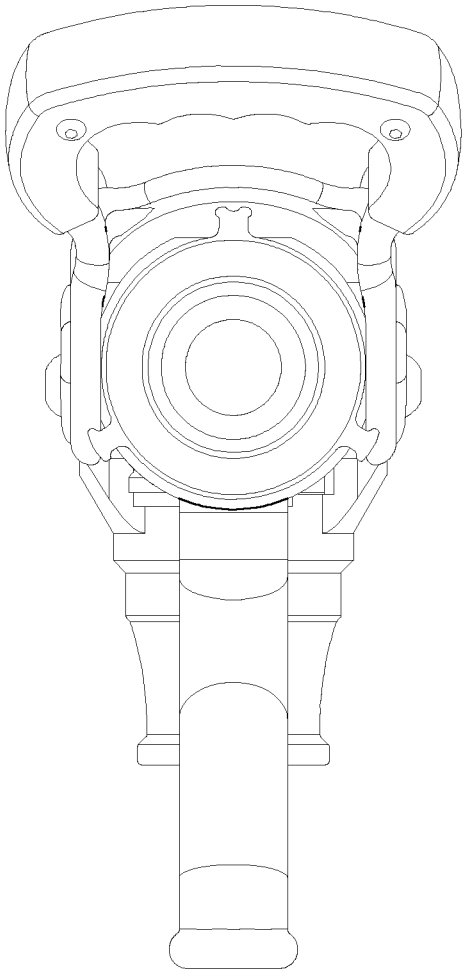
Figure 2D:
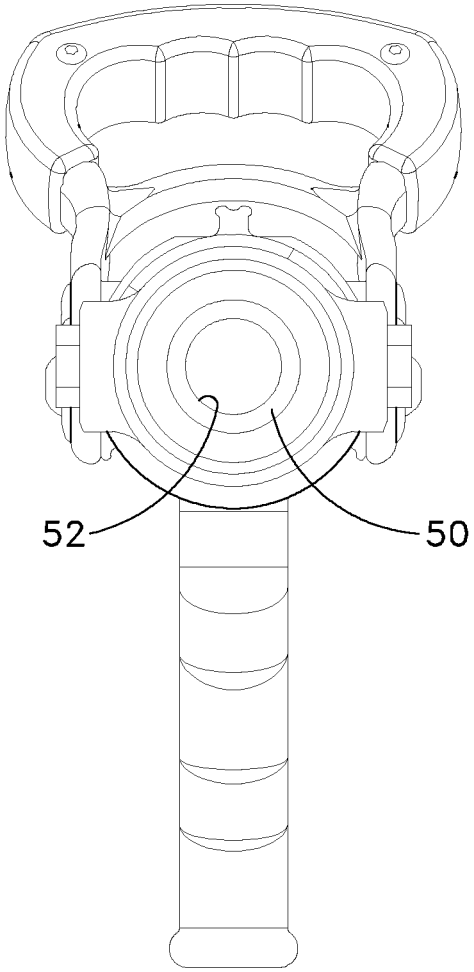
Figure 2E:
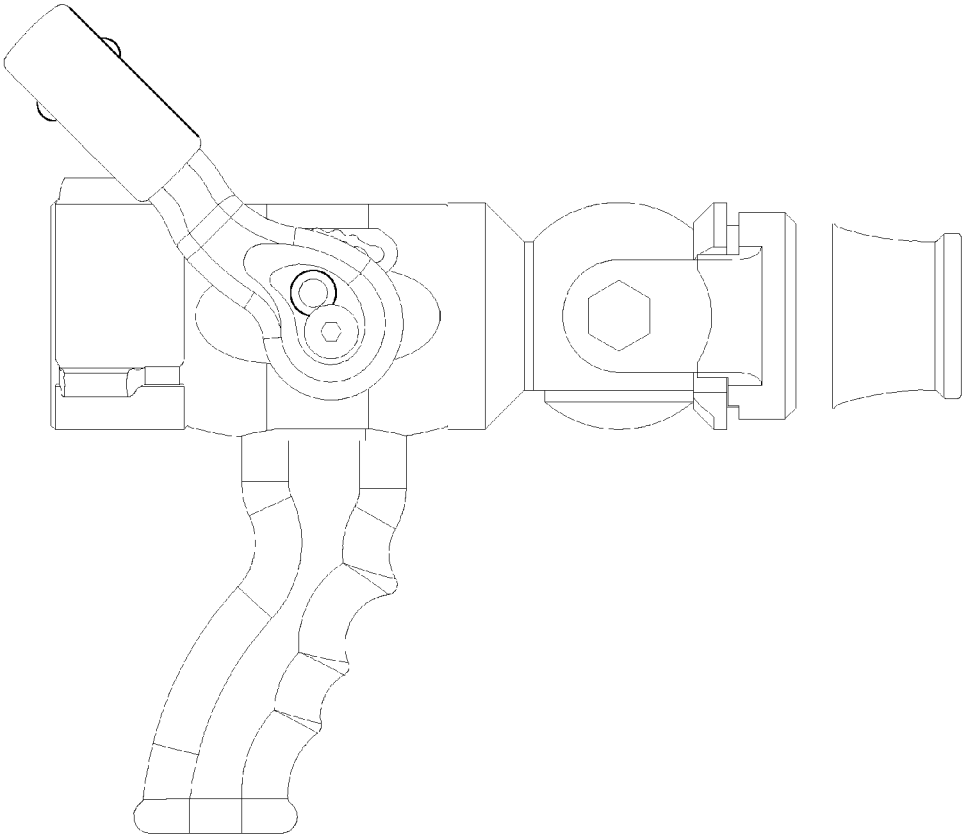
Figure 2F:
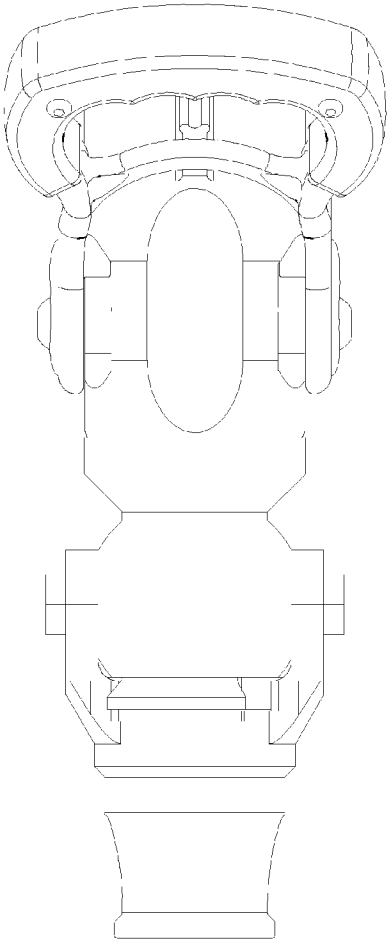
Figure 2G:
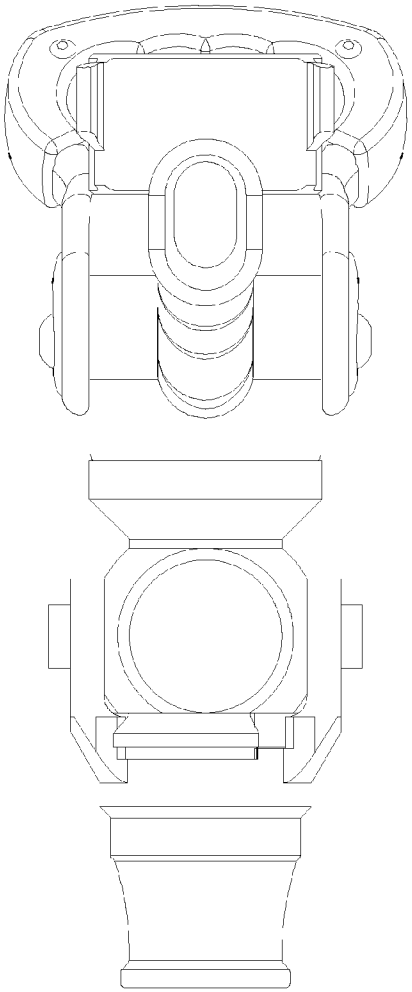
Figure 3A:
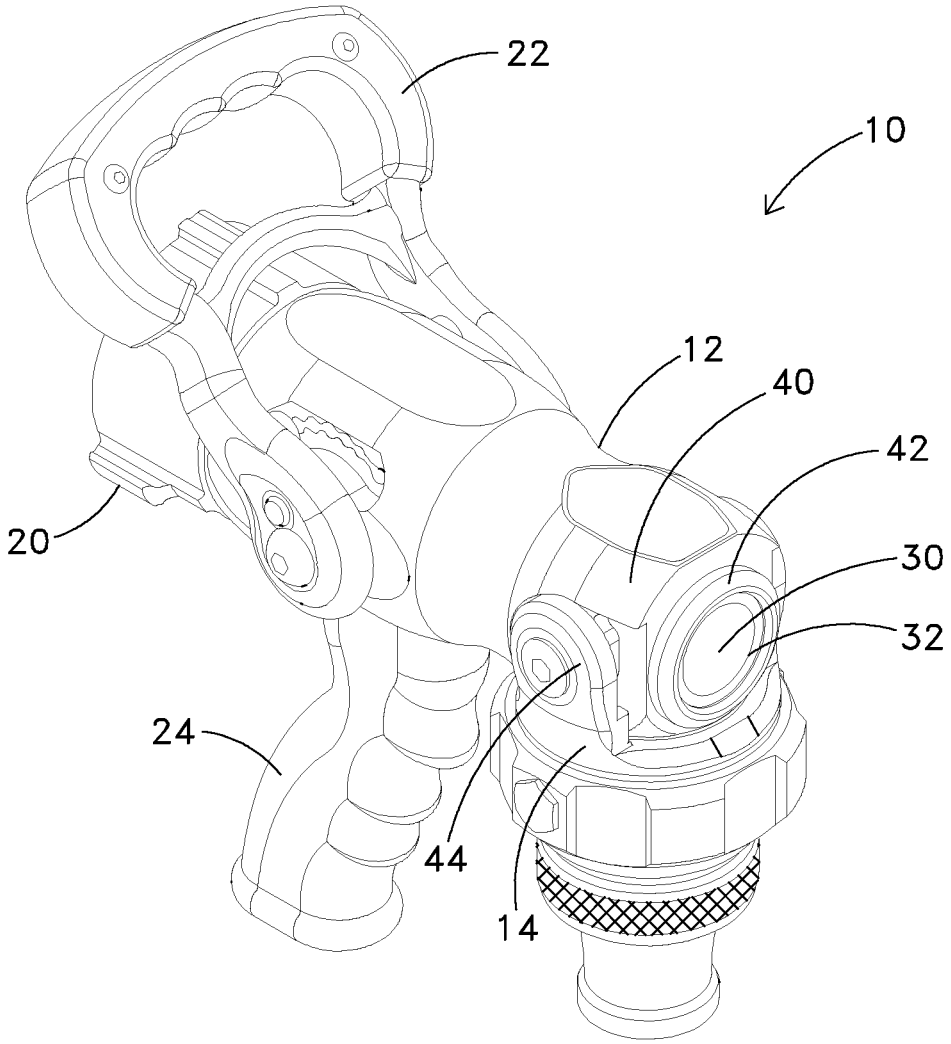
FIGS. 3A-G are isometric and back, front, side, top, and bottom views of a second firefighting nozzle that uses the new invention.
Figure 3B:
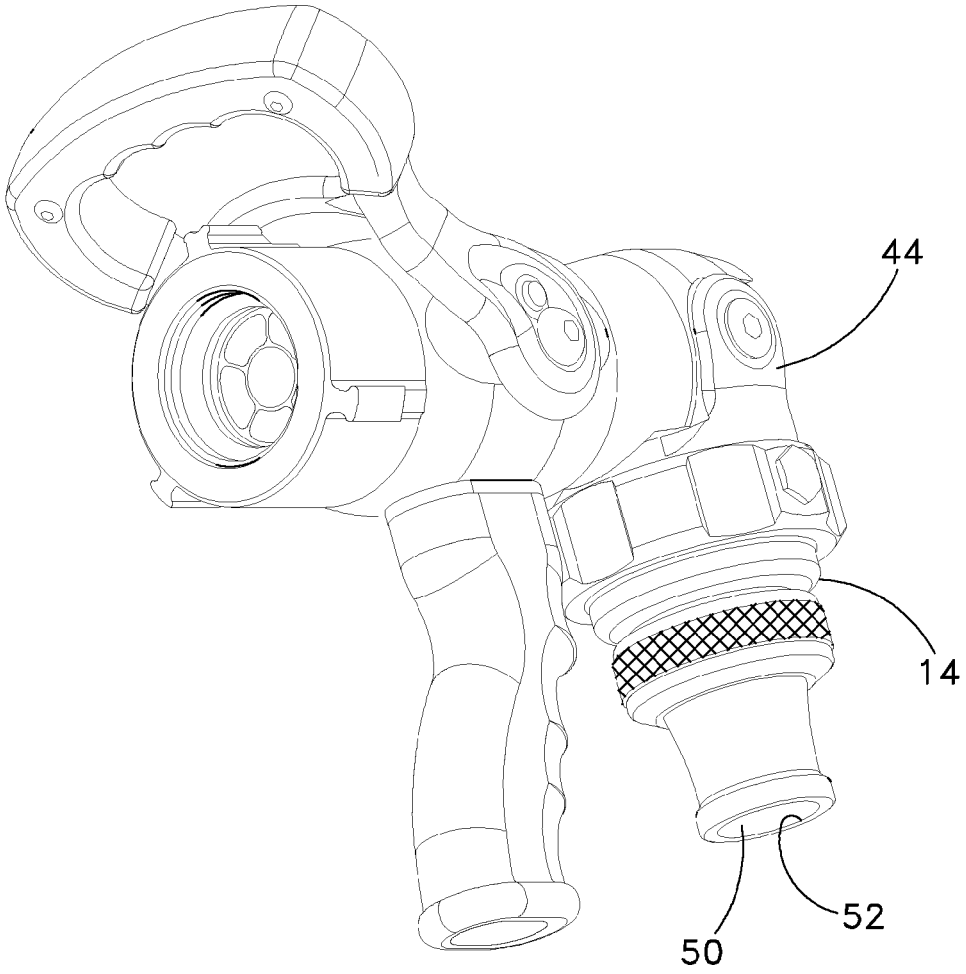
Figure 3C:
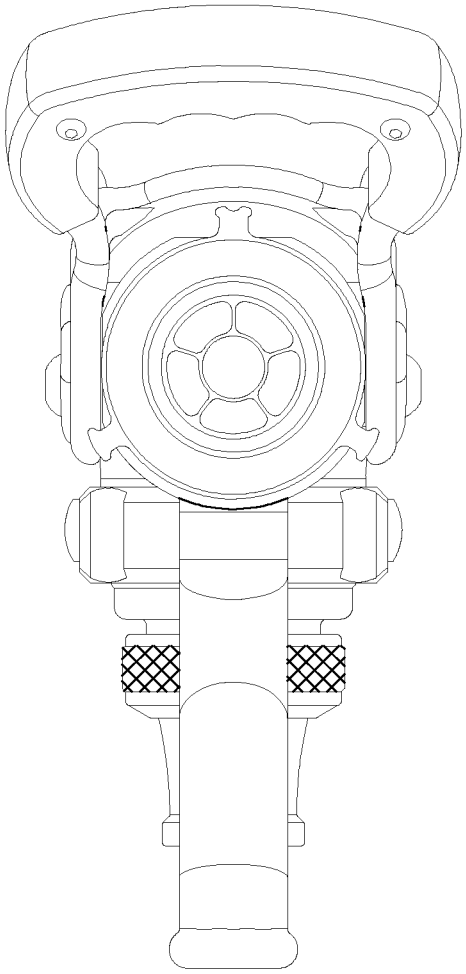
Figure 3D:
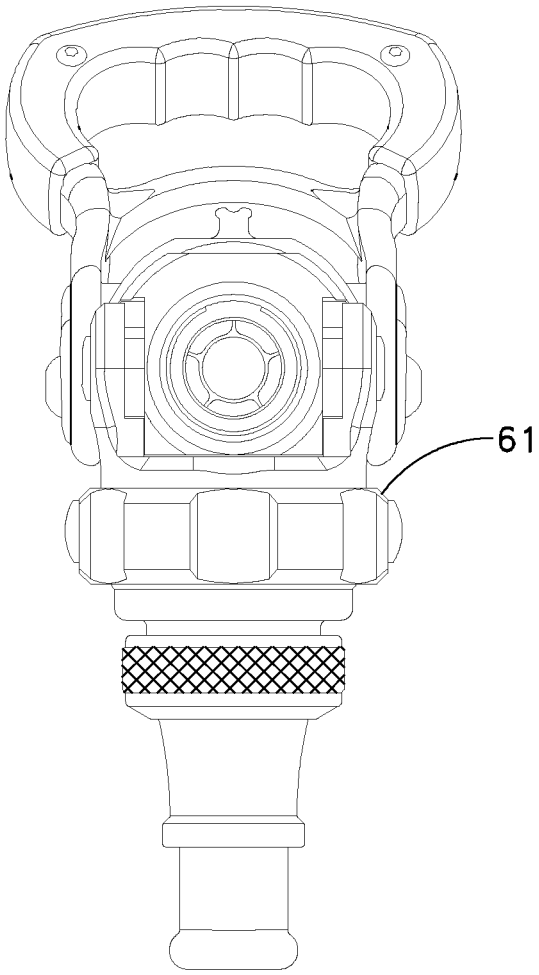
Figure 3E:
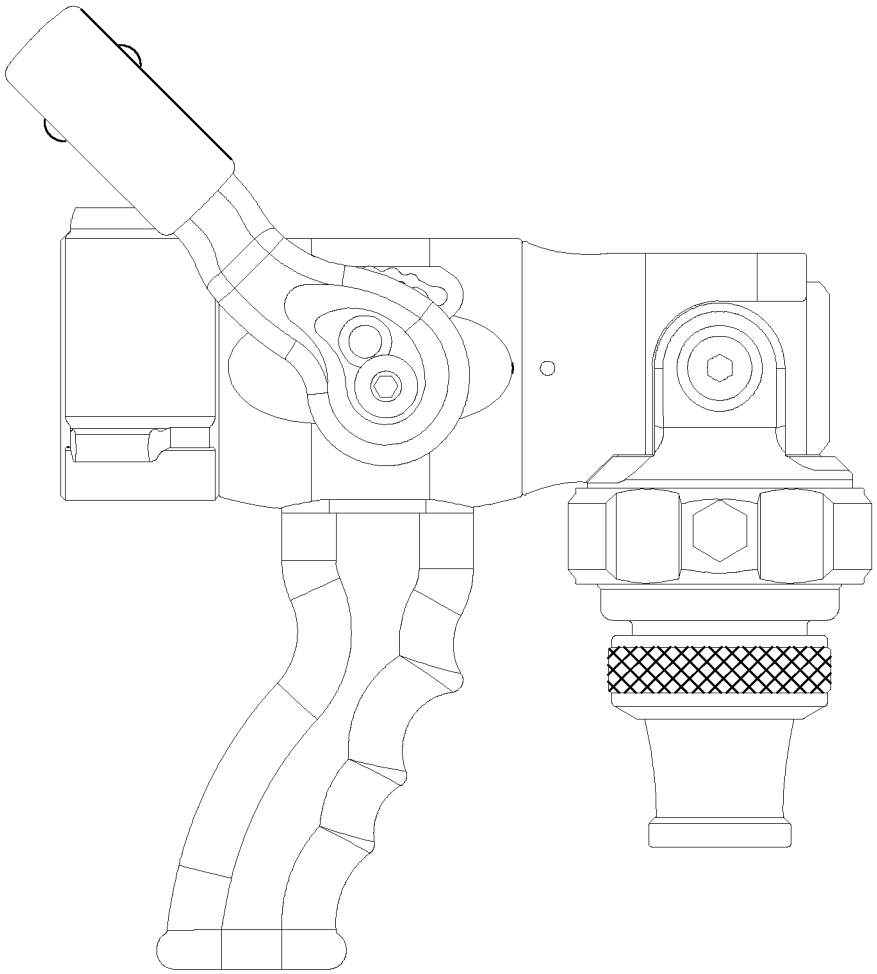
Figure 3F:
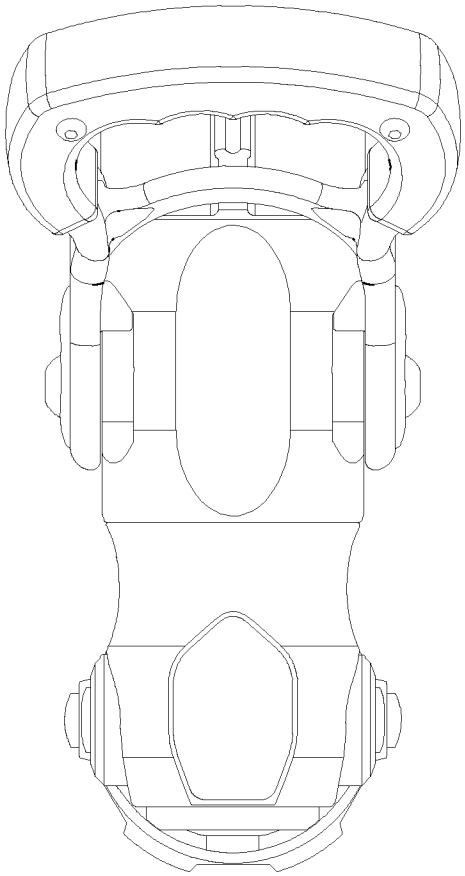
Figure 3G:
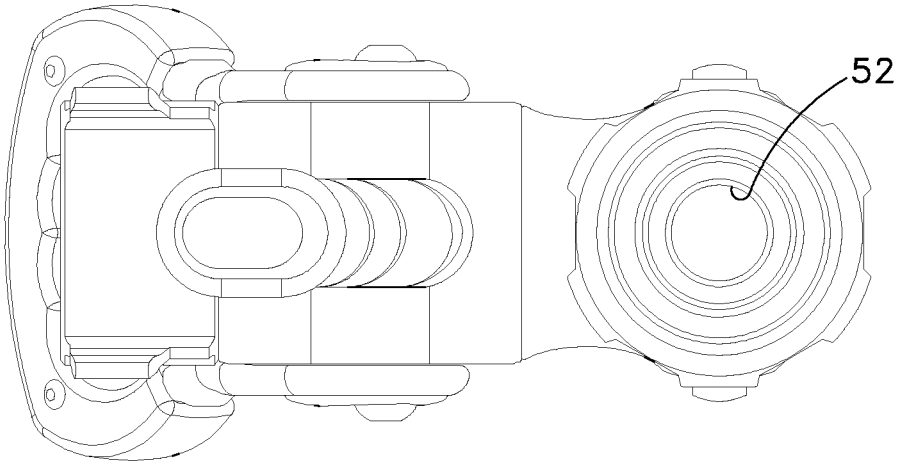
Figure 4A:
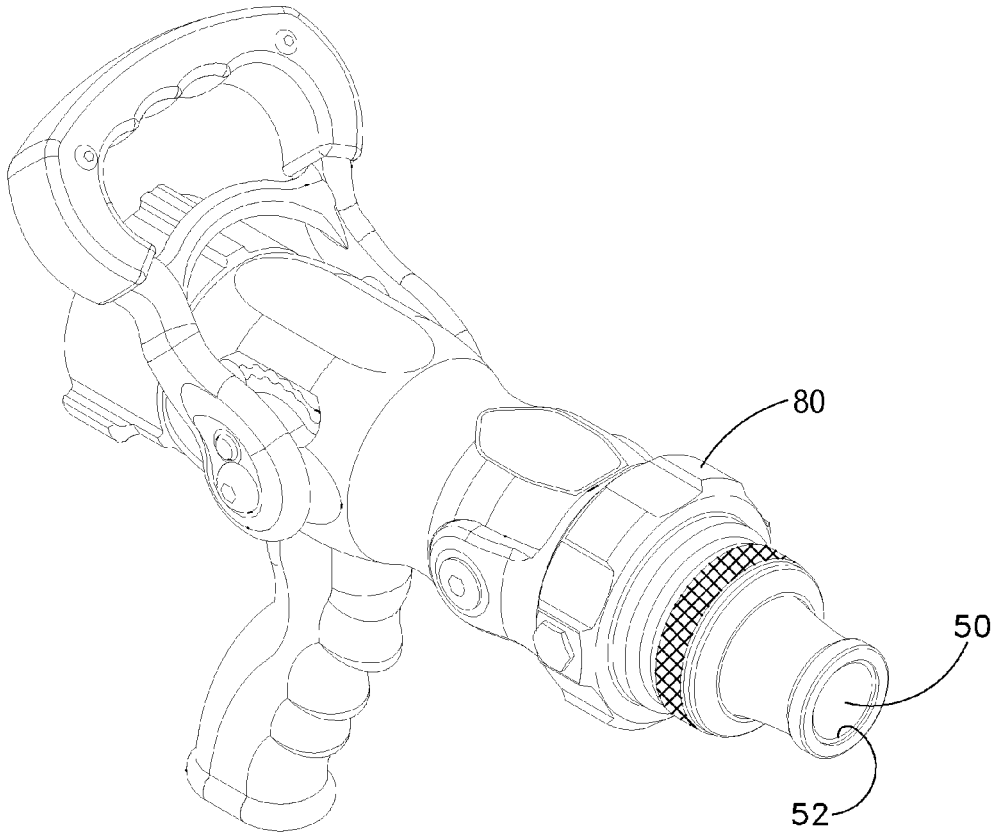
FIGS. 4A-G are similar views of the second nozzle in a different position.
Figure 4B:
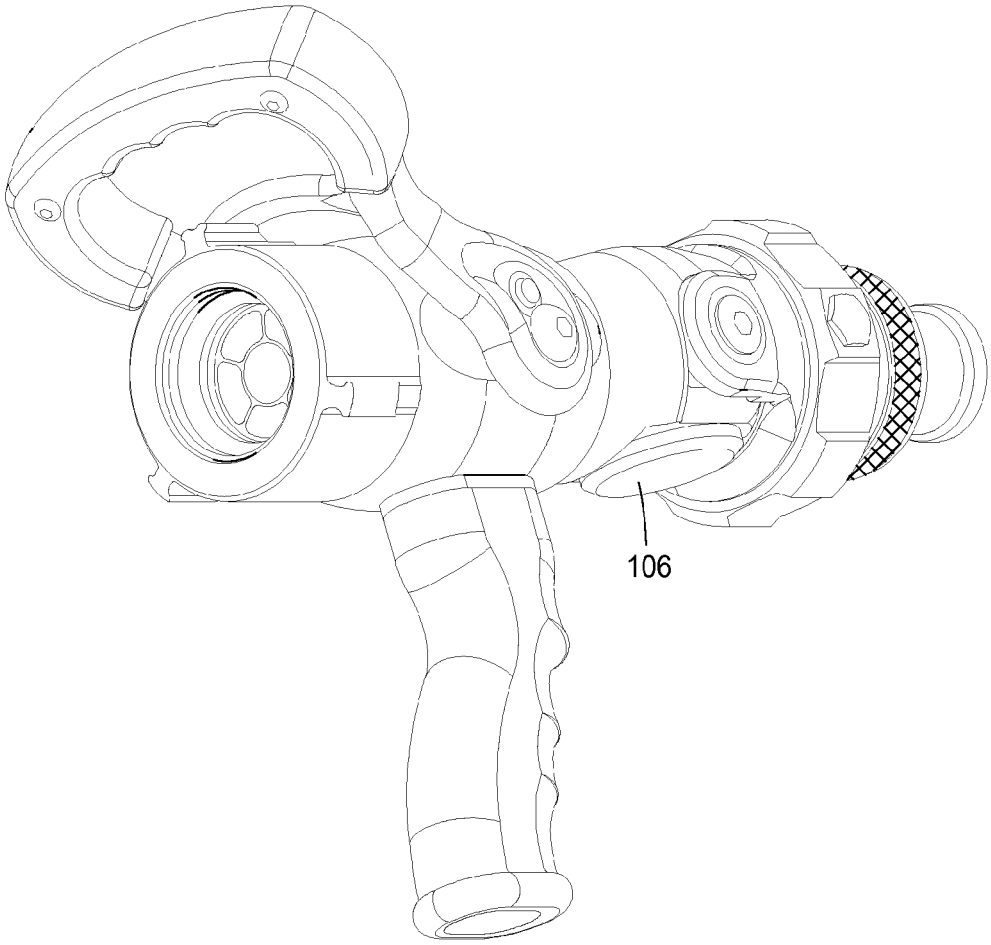
Figure 4C:
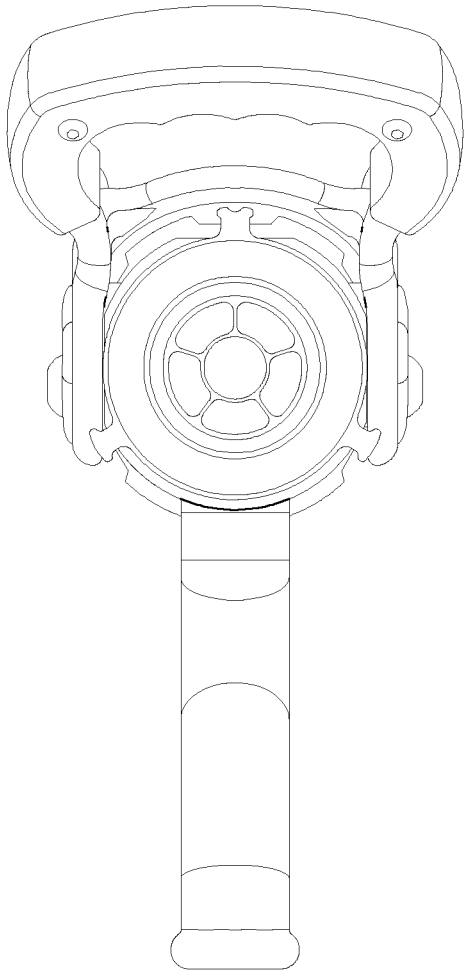
Figure 4D:
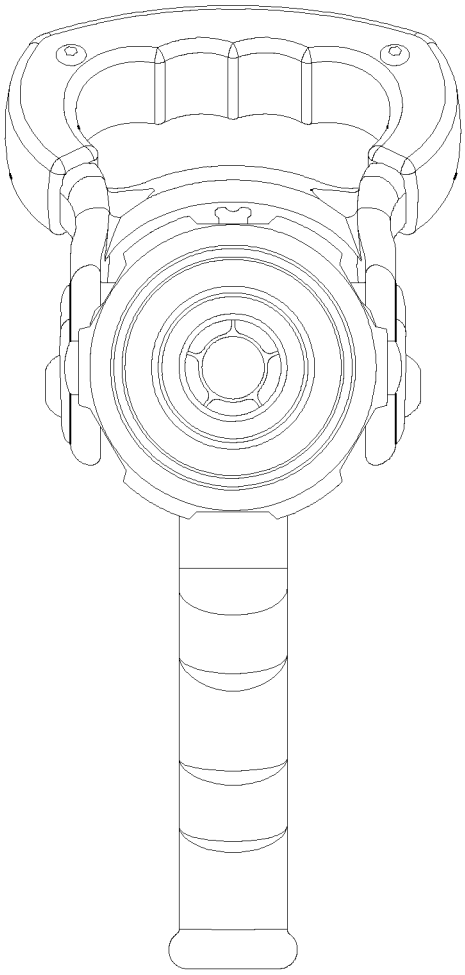
Figure 4E:
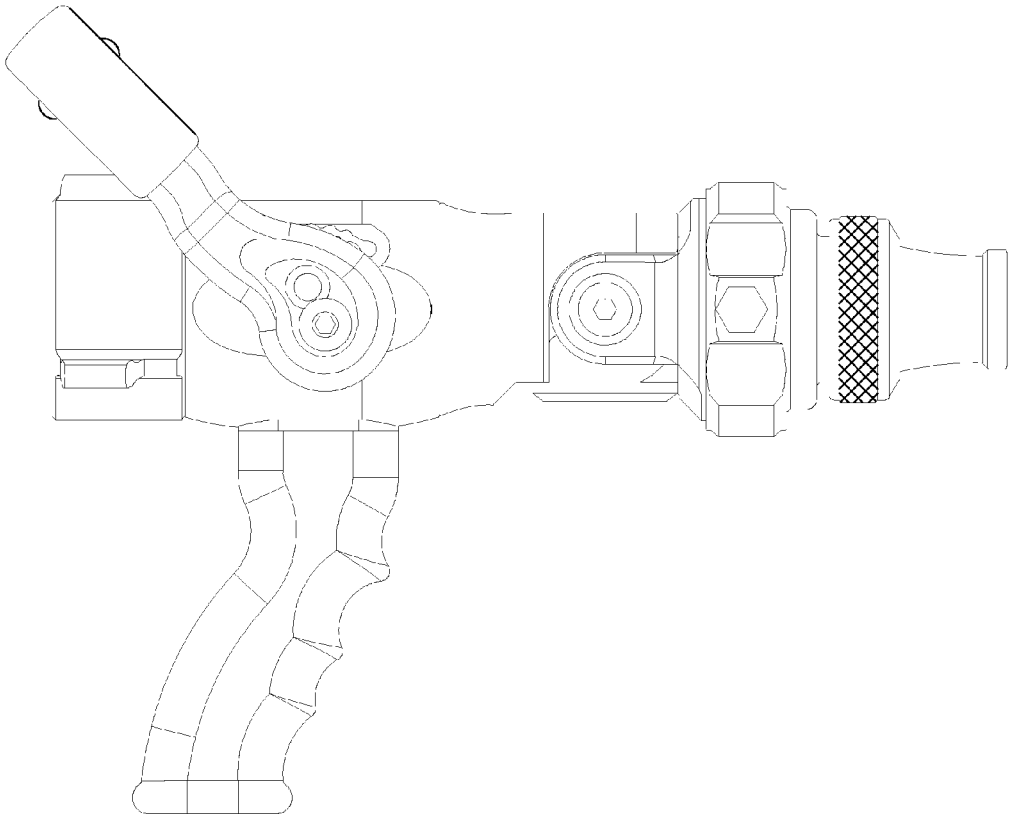
Figure 4F:
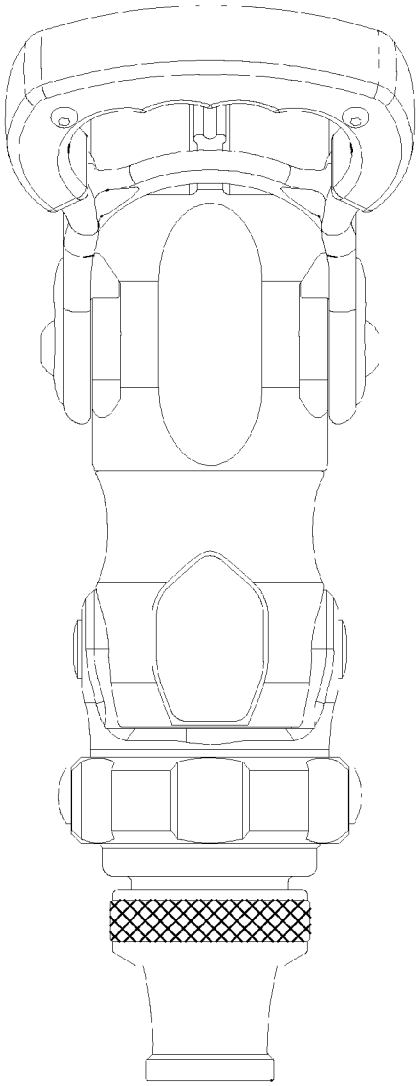
Figure 4G:
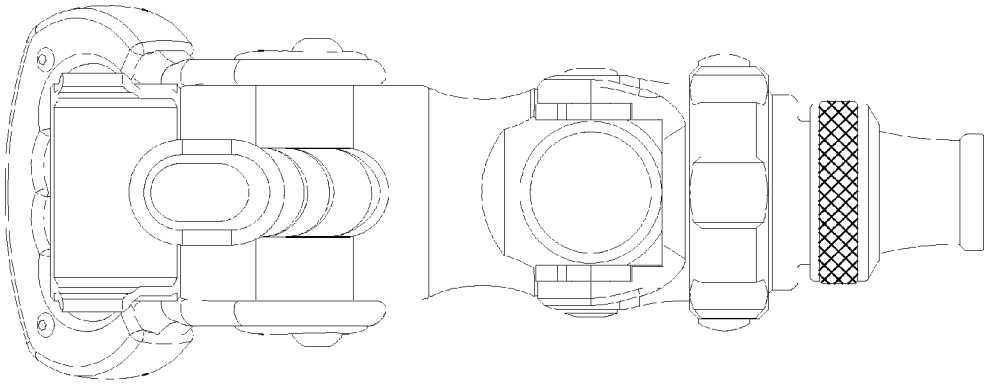
Figure 5:
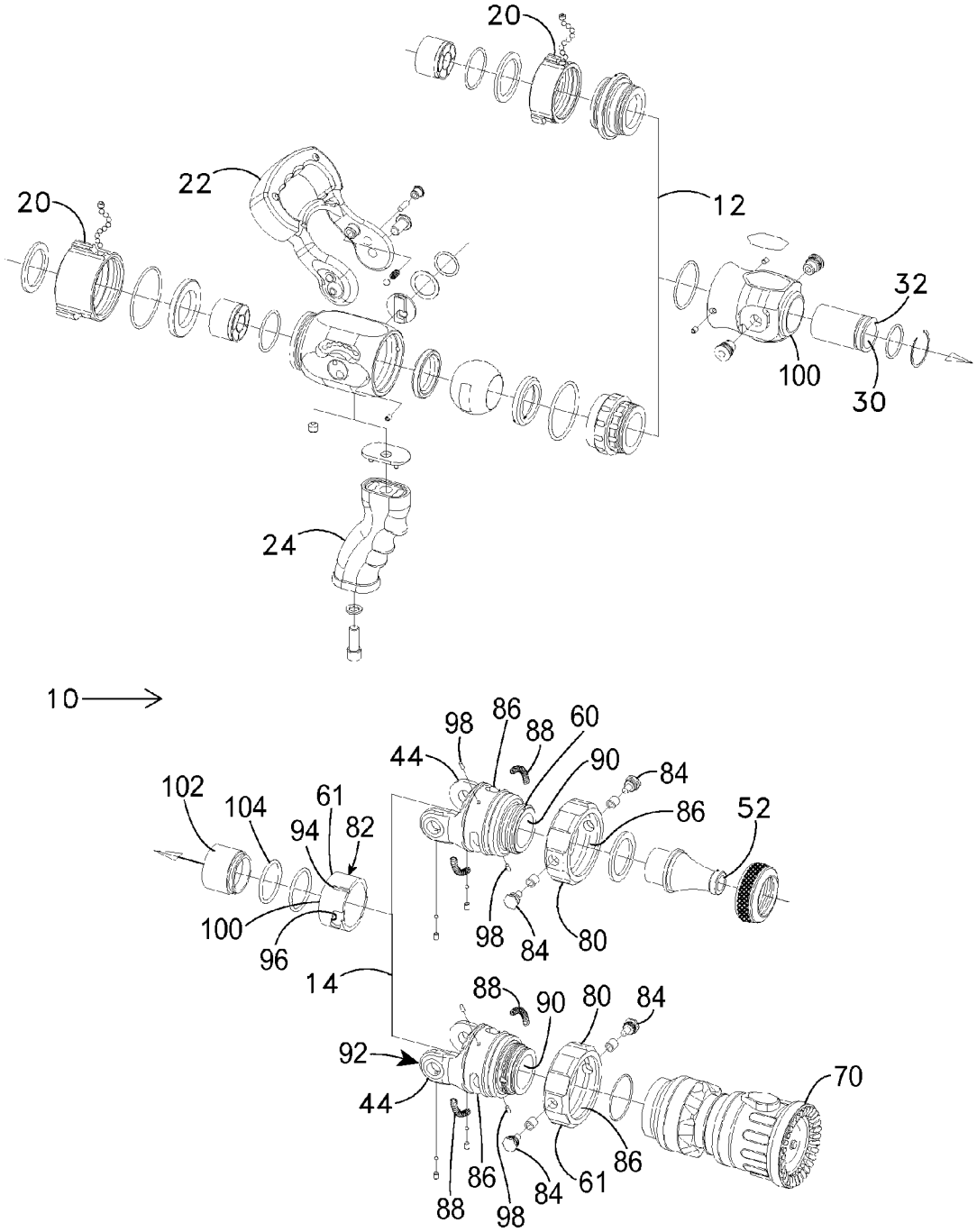
FIG. 5 is an exploded isometric view of the second nozzle, with alternative auxiliary nozzles.

Spring loaded detents which hold the position until forced onto another position A manually operated lock such as a pull-pin which is manually dis-engageable as desired A manually operated lock such as a ring or lever which is manually dis-engageable as desired, but is configured to include a secondary lock, such as the locking ring 61 seen in FIGS. 1D and 2A, which a user can slide over a shoulder 62 when the auxiliary nozzle is engaged to inhibit unintentional manual disengagement.

A hydraulically operated lock that engages a movable member in response to fluid pressure, said member automatically disengaging when pressure is released to permit freedom of motion between the two positions The nozzle seen in FIGS. 3 and 4 has locking elements on the auxiliary nozzle 14 that can be used to lock the auxiliary nozzle in either the stowed position (seen in FIG. 3) or the operating position (seen in FIG. 3). These elements include a collar 80 mounted for rotation around the auxiliary nozzle and a retracting sleeve 82 that fits within the bore auxiliary nozzle.

The collar 80 is mounted for rotation about the circumference of the auxiliary nozzle 14, and has a pair of stems 84 that project radially inwardly through a radial groove 86 in the auxiliary nozzle. Although other arrangements can be used, the illustrated stems are biased to a locking radial position in the groove by a pair of circumferentially mounted springs 88. By rotating the collar, a firefighter can cause the stems to move through the groove from the locking radial position to a releasing radial position.

The retracting sleeve 82 is an annular member that fits within a cylindrical part of a fluid bore 90 through the main body 92 auxiliary nozzle 14. The outer surface of the sleeve has a pair of straight grooves 94 and a pair of angled tracks 96.

The straight grooves 94 extend parallel to the centerline of the sleeve. These grooves receive a pair of pins 98 that extend inwardly from the main body into the fluid bore. The engagement of the pins in the grooves allow the sleeve to move axially within the fluid bore 90, but prevent the sleeve from rotating within the fluid bore.

The angled tracks 96 receive the inner ends of the stems 84. With the sleeve 82 being inhibited from rotating within the fluid bore 90, the angle of the tracks cause the sleeve move axially within the bore, retracting (moving downstream) from an extended position (when the stems are in the locking radial position) to a retracted position (when stems are in the releasing radial position).

The upstream end of the retracting sleeve 82 takes the form of a locking ring 98 that fits over a shoulder 100 on the primary orifice 32 on the base nozzle 12. When the sleeve is in the extended position, engagement of the locking ring over the shoulder secures the auxiliary nozzle 14 in position for the second mode of operation. As the sleeve retracts, it withdraws from the shoulder, ultimately freeing the auxiliary nozzle to be rotated so that its fluid bore 90 is out of alignment with the bore 30 through base nozzle. This enables the nozzle to be used in the large-flow mode.

A secondary sleeve 102 and one or more o-rings 104 can be used to channel flow through the auxiliary nozzle 14.

The illustrated base nozzle 12 has a closed stem 106 that aligns with the fluid bore 90 in the auxiliary nozzle 14 when the auxiliary nozzle is moved to the stowed position. When the auxiliary nozzle is in this position, the force of the springs 88 on the stems 84 and subsequently on the sleeve 82 urges the locking ring 98 to extend over and engage the closed stem, releasably locking the auxiliary nozzle in the stowed position.

Figure 13:
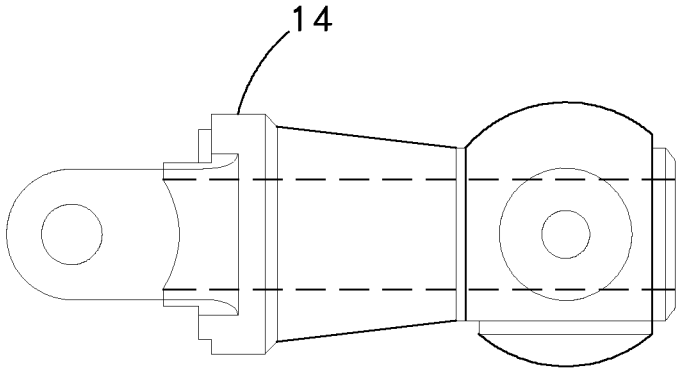
FIG. 13 is a side view of an alternative auxiliary nozzle that could be used with the nozzle of FIGS. 1 and 2 and has a ball swivel discharge.
Figure 14:
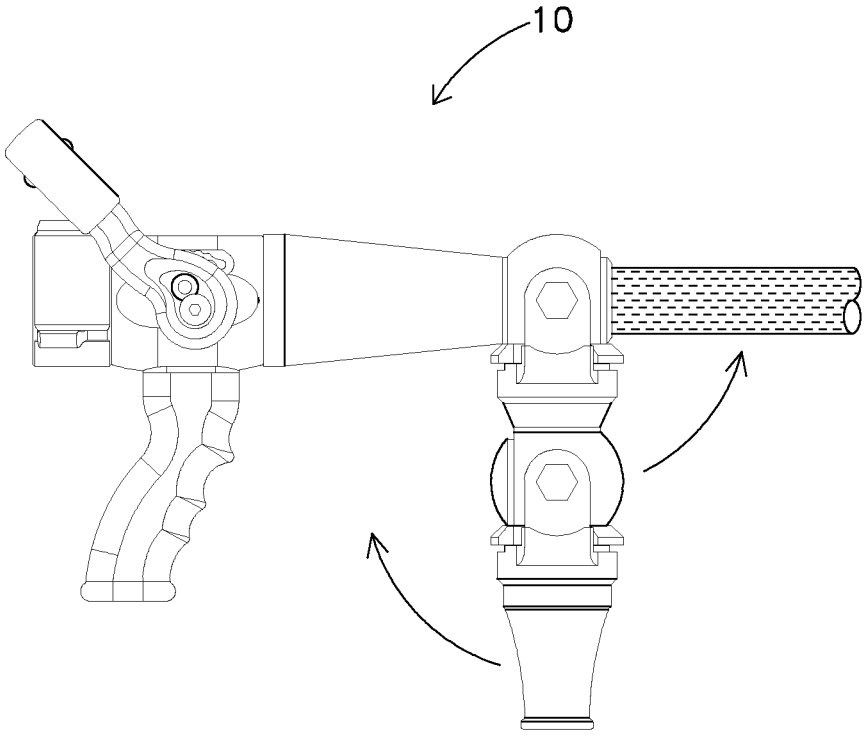
FIGS. 14-16 are side views of an embodiment of a firefighting nozzle that uses the auxiliary nozzle seen in FIG. 13, in different use modes.
Figure 15:
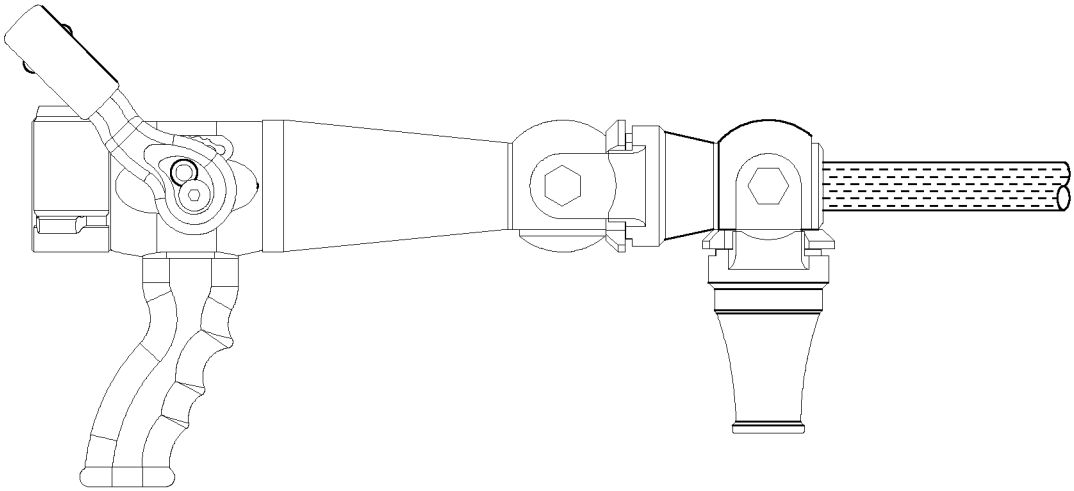
Figure 16:
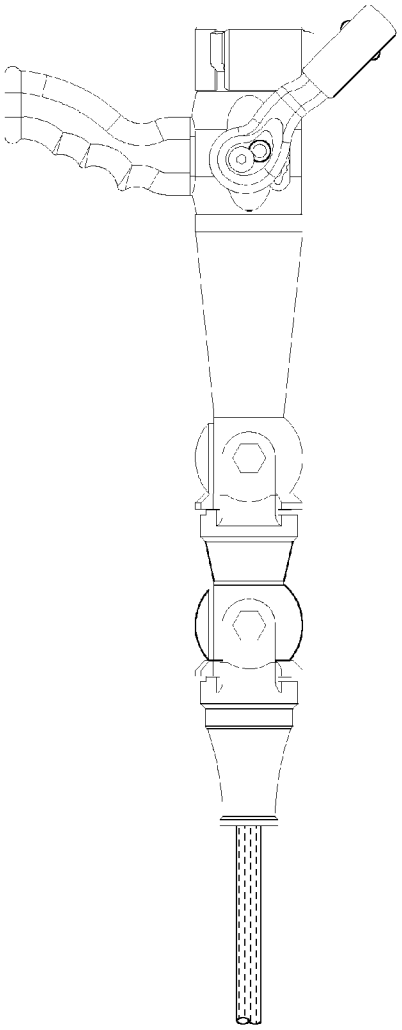

The auxiliary nozzle can also be provided with a ball swivel discharge, as seen in FIG. 10. This arrangement enables a series of nozzles or tips to quickly and easily added or removed from action, as illustrated in FIGS. 11-13.

What is claimed is:

1. A firefighting nozzle attachable to a fire hose or fire monitor, connectable to a pressurized source of liquid, comprising:

a base nozzle that has an orifice that is configured to deliver a liquid stream at a rate effective for firefighting; and an auxiliary nozzle that has an orifice of a different size or type;

a pivot that enables the auxiliary nozzle to be swung between (1) an operating position in which the auxiliary nozzle (a) is in series with as well as coaxial with the base nozzle, and (b) a stowed position in which the auxiliary nozzle remains is connected to the base nozzle but is completely out of the path of liquid flow from the base nozzle.

2. A firefighting nozzle as recited in claim 1, in which:

the auxiliary nozzle pivots about an axis that crosses the flow path in the base nozzle; and the nozzle has one or more locking elements on the auxiliary nozzle that lock the auxiliary nozzle in the operating position with sufficient force to withstand the pressures developed in a firefighting nozzle.

3. A firefighting nozzle as recited in claim 2, in which the locking elements include a locking ring that moves between two positions while the auxiliary nozzle is in the operating position, one position in which it fits over a shoulder, locking the auxiliary nozzle in the operating position, and another position in which it retracts from the shoulder, and frees the auxiliary nozzle to swing from the operating position.

4. A firefighting nozzle as recited in claim 1, in which the base nozzle is a smooth-bore nozzle and the auxiliary nozzle is a smooth-bore nozzle.

5. A firefighting nozzle as recited in claim 4, in which the base nozzle and the auxiliary nozzle, when connected in series, form an unobstructed, tapered internal flow path.

6. A fire-fighting nozzle as recited in claim 5, in which the base nozzle and the auxiliary nozzle are each smooth-bore nozzles with fixed walls.

7. A firefighting nozzle as recited in claim 1, in which the auxiliary nozzle modifies shape of the discharge pattern of flow emanating from the base nozzle.

8. A firefighting nozzle as recited in claim 1, in which the auxiliary nozzle has a standard fire hose connection onto which a nozzle tip can be attached without the use of tools.

9. A firefighting nozzle as recited in claim 1, in which a second auxiliary nozzle is mounted to the auxiliary nozzle, and arranged so that it can be successively added in series to a base nozzle or to the auxiliary nozzle.

10. A firefighting nozzle as recited in claim 1, in which both the base nozzle and auxiliary nozzle have unobstructed internal waterways and it is visually ascertainable under firefighting conditions whether the auxiliary pathway is connected for use.

11. A firefighting nozzle as recited in claim 1, in which the size of the orifice that is connected for use can be determined by visual observation of the position of a relatively large element that moves non-axially.

12. A firefighting nozzle as recited in claim 1, in which:

the auxiliary nozzle is rotated between the stowed position and the operating position about an axis that is perpendicular to the direction of flow through the base nozzle;

liquid can be sprayed through the base nozzle while the auxiliary nozzle is in the stowed position; and the auxiliary discharge nozzle, when in the stowed position, extends generally parallel to and in front of a pistol grip on the base nozzle.

13. A firefighting nozzle as recited in claim 1, in which:

the base nozzle is on a base that has a closed stem;

the auxiliary nozzle is a pivoting nozzle that has an inlet that, in the operating position, adjoins the outlet on the base and, in the stowed position, adjoins the closed stem on the base; and the auxiliary nozzle also has locking elements that move with respect to the inlet on the auxiliary nozzle and selectively lock the pivoting nozzle in the operating position.

14. A firefighting nozzle as recited in claim 13, in which at least one of the locking elements is biased toward a locking position in which the pivoting nozzle is locked in position.

15. A firefighting nozzle as recited in claim 13, in which the locking elements include:

a retractable sleeve that moves axially within a main body of the pivoting nozzle and locks the pivoting nozzle to the orifice when the pivoting nozzle is in the operating position and locks the nozzle to the closed stem when the pivoting nozzle is in the secondary position;

a collar that rotates about the pivoting nozzle; and means for retracting the sleeve when the collar is rotated and thereby freeing the pivoting nozzle for rotation between the operating and stowed positions.

16. A firefighting nozzle as recited in claim 15, in which the sleeve and the pivoting nozzle have:

a stem that travels in an angled track; and a pin and groove that retain the rotational position of the sleeve with respect to the pivoting nozzle.

17. A firefighting nozzle attachable to a fire hose or fire monitor, connectable to a pressurized source of liquid, comprising:

a base nozzle that has a primary orifice;

an auxiliary nozzle that has a secondary orifice that has a configuration that differs from the configuration of the primary orifice;

a pivot that enables the auxiliary nozzle to be swung between (1) an operating position in which the auxiliary nozzle (a) is in series with as well as coaxial with the base nozzle, and (b) a stowed position in which the auxiliary nozzle remains is connected to the base nozzle but is completely out of the path of liquid flow from the base nozzle; and a locking mechanism that rotates about one of the two nozzles, causing a locking ring to selectively extend over or retract from a collar on the other of the nozzles, preventing rotation of the two nozzles with respect to each other when the locking ring extends over the collar, and permitting the two nozzles to be rotated with respect to each other when the locking ring extends over the collar.

18. A firefighting nozzle attachable to a fire hose or fire monitor, connectable to a pressurized source of liquid, comprising:

a base nozzle that has an orifice that is configured to deliver a liquid stream at a rate effective for firefighting; and an auxiliary nozzle that has an orifice of a different size or type;

a ball-in-socket pivot that has an axis of rotation that is coincident with the discharge axis of the base nozzle and enables the auxiliary nozzle to be swung between (1) an operating position in which the auxiliary nozzle (a) is in series with as well as coaxial with the base nozzle, and (b) a stowed position in which the auxiliary nozzle remains is connected to the base nozzle but is completely out of the path of liquid flow from the base nozzle.

* * * * *